US005605439A

United States Patent [19]

Endoh et al.

[11] Patent Number: 5,605,439

[45] Date of Patent: Feb. 25, 1997

[54] DRAINAGE PUMP

[75] Inventors: Takashi Endoh; Tatsushi Ninomiya; Masayuki Imai, all of Tokyo, Japan

[73] Assignee: Fujikoki Corporation, Tokyo, Japan

[21] Appl. No.: 651,524

[22] Filed: May 22, 1996

[30] Foreign Application Priority Data

Aug. 29, 1995 [JP] Japan ..... 7-220250

[51] Int. Cl.[6] ..... F04D 1/00

[52] U.S. Cl. ..... 415/199.4; 416/175; 416/182; 416/189; 416/201 A

[58] Field of Search ..... 415/199.4, 199.6; 416/175, 179, 182, 189, 203, 201 A

[56] References Cited

U.S. PATENT DOCUMENTS 3,110,748 11/1963 Myklebust ..... 416/175

5,209,641 5/1993 Hoglund et al. ..... 416/181

*Primary Examiner*—James Larson

*Attorney, Agent, or Firm*—Foley & Lardner

[57] ABSTRACT

A drainage pump 1 comprises a pump housing 40 defining a suction inlet 42, a pumping chamber 44 and a delivery outlet 46, and a cover 32. An impeller 50 accommodated in the pump housing is driven by a motor 10. The impeller 50 comprises a shaft 52 coupled to an output shaft of the motor 10, large-radius vanes 60 in form of flat plates radially extending from the shaft 52, and small-radius vanes 54 continuous from the large-radius vanes 60. Outer circumferential edges of the large-radius vanes 60 are connected by a cylindrical wall member 64, and outer circumferential parts of lower edges of the large-radius vanes 60 are connected by an annular member 62. The cylindrical wall member 64 has a rounded portion 70 at its upper end, and the small-radius vanes 54 also have rounded portions 57 at their lower ends.

4 Claims, 4 Drawing Sheets

DRAINAGE PUMP

BACKGROUND OF THE INVENTION

1. Field of the Invention

This invention relates to a drainage pump, in particular, for use in an air conditioner.

2. Related Art

In an indoor unit of an air conditioner in refrigerating operation, moisture in the air condenses into waterdrops in a heat exchanger and falls into a drain pan located under the heat exchanger. A drainage pump is equipped to discharge water from the drain pan. There are various conventional types of drainage pumps, including one comprising an upper-opened housing having a suction inlet in its bottom wall and a delivery outlet in a side wall, and an impeller accommodated in the housing and rotated by a motor fixed above the opening of the housing via a cover. The axle of the motor rotatably extends through and beyond the cover and is coupled to the axle of the impeller. The cover has a through bore communicating the interior space of the housing with the atmospheric air. When the impeller is driven by the motor, water in the drain pan is drawn by the lower end of the impeller, pumped by the centrifugal force, and discharged through the outlet to the exterior.

The conventional drainage pump involves the problem that noise occurs when drainage of water starts. This is caused by bubbles that are produced from the liquid around the impeller and hit the impeller and interior surfaces of the housing.

SUMMARY OF THE INVENTION

It is therefore an object of the invention to provide a drainage pump overcoming the above problem.

According to the invention, there is provided a drainage pump having a motor, an impeller connected to a drive shaft of the motor and a housing accommodating the impeller, which is characterized in that the impeller comprises a shaft connected to the drive shaft of the motor, a plurality of long-radius vanes in form of flat plates radially extending from the shaft, short-radius vanes in form of flat plates extending continuous from lower ends of the longer vanes, a cylindrical wall member connecting radially outer ends of the longer vanes, and an annular member extending radially inward from the cylindrical wall member along the lower ends of the longer vanes.

DESCRIPTION OF THE PREFERRED EMBODIMENTS

Figure 1:
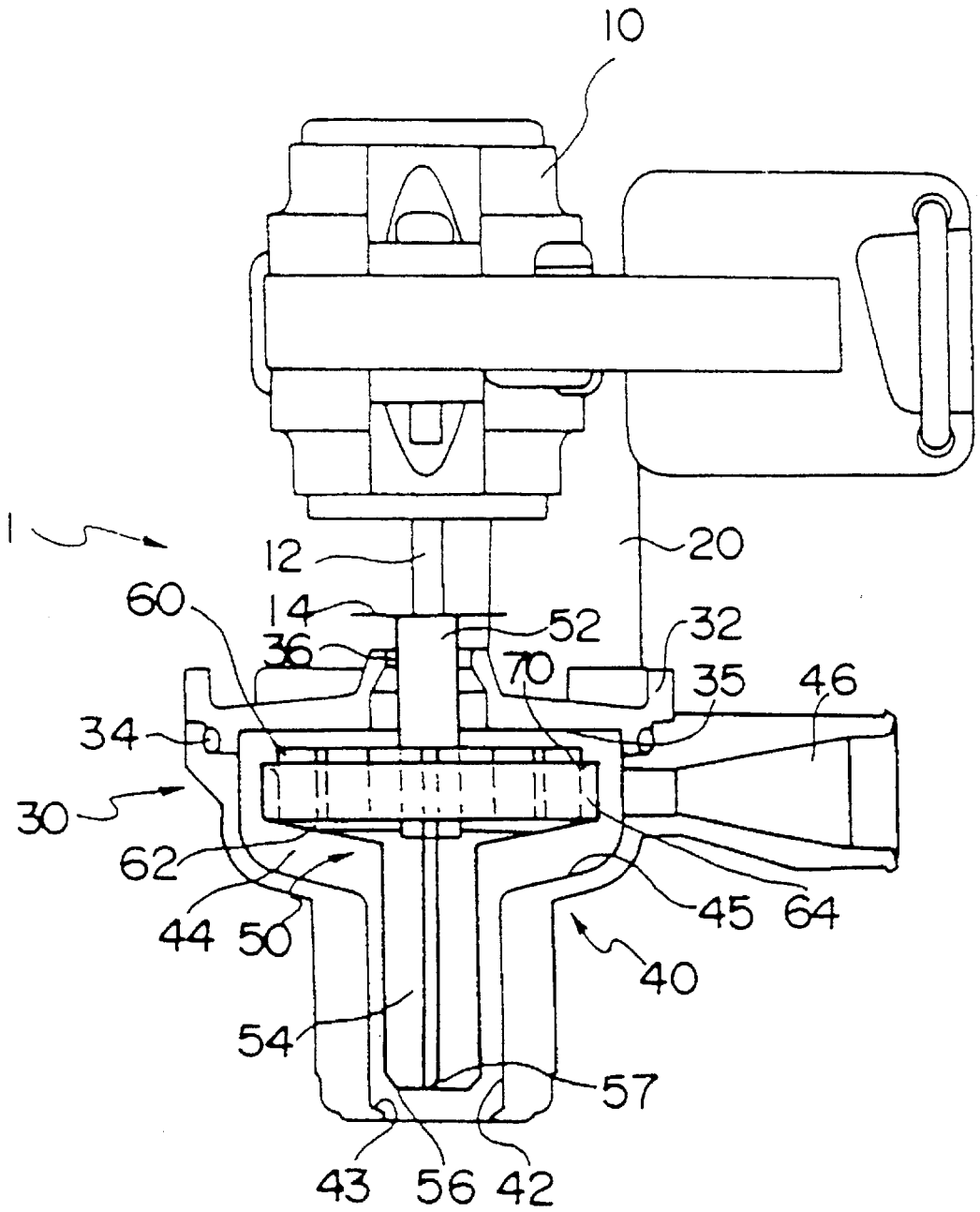
FIG. 1 is a partly cross-sectional, side-elevational view of a drainage pump according to the invention.

FIG. 1 is a side-elevational view of a drainage pump according to the invention, a part of which is illustrated in a cross-sectional view.

A drainage pump, generally shown at 1, comprises a motor 10, and a pump body 30 connected to the lower end of the motor 10 via a bracket 20. The bracket 20 is integral with a cover 32 which is an upper member of a pump housing, and the cover 32 is connected to a housing 40 via a seal member 34.

The housing 40 is made of a plastic resin, and has formed a suction inlet 42, a pump chamber 44, and a delivery outlet 46.

The pump housing 40 accommodates an impeller 50 which comprises a shaft 52 and a plurality of short-radius vanes 54 in form of flat plates radially extending from the axis of the shaft 52. In the illustrated embodiment, the impeller 50 has four short-radius vanes 54.

The shaft 52 extends toward the motor 10 through and beyond a through hole 36 formed in the center of the cover 32, and receives a drive shaft 12 of the motor in an axial hole formed in the shaft 52. A water-guard disk 14 is attached on the upper end of the shaft 52 to prevent that water sprayed from the through hole 36 of the cover 32 splash onto the motor 10.

The short-radius vanes 54 of the impeller 50 are inserted into a pipe-shaped suction inlet of the housing. The suction end of the suction inlet is tapered to gradually decrease the inner diameter toward the open end, and the small-radius vanes 54 have bevelled ends 56 following the shape of the suction end. A pumping chamber 44 defined by the pump housing 40 accommodates the larger-radius vanes 60 of the impeller 50.

Figure 2:
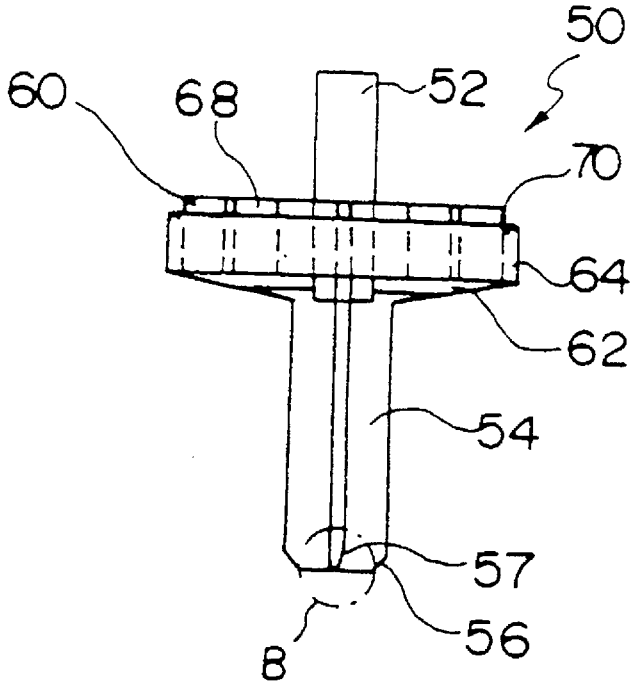
FIG. 2 is a side-elevational view of an impeller.
Figure 3:
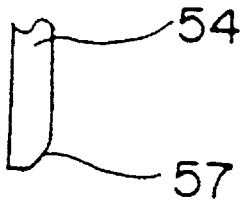
FIG. 3 is a fragmentary view showing the part B of FIG. 2 in an enlarged scale.
Figure 4:
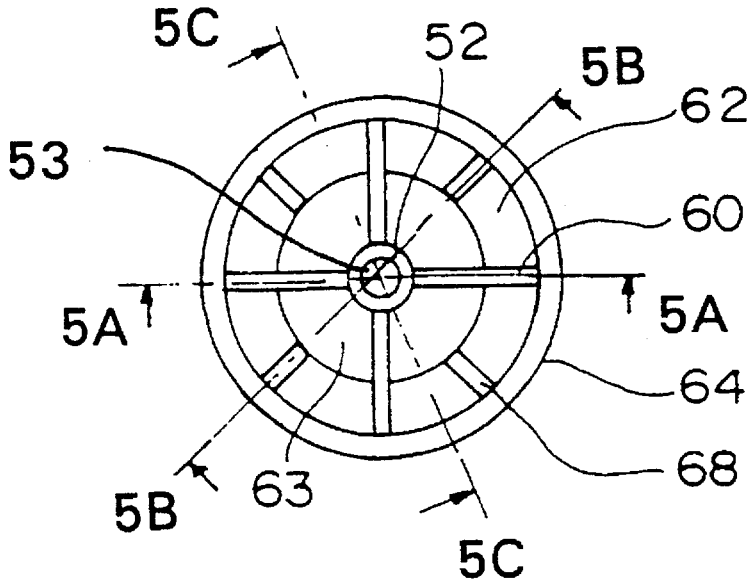
FIG. 4 is a plan view of the impeller.
Figure 5A:
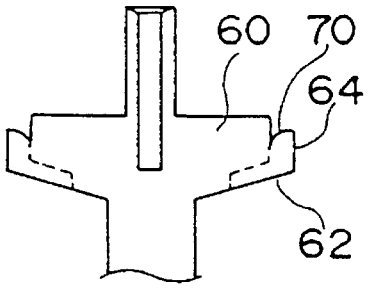
FIGS. 5A, 5B and 5C are cross-sectional views for explaining the impeller shown in FIGS. 2 through 4.
Figure 5B:
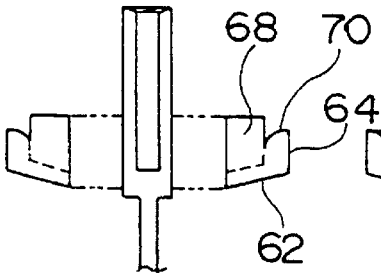
Figure 5C:
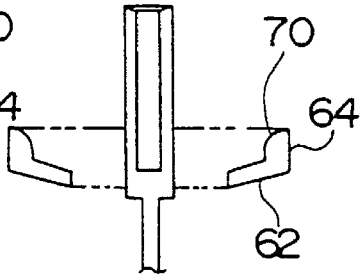

FIG. 2 is a side-elevational view of the impeller 50, FIG. 3 is an enlarged view of the part B of FIG. 2, FIG. 4 is a plan view of the impeller 50, and FIGS. 5A, 5B and 5C are fragmentary cross-sectional views taken along the A—A line, B-B line and C—C line of FIG. 4, respectively.

The impeller 50 has large-radius vanes 60 in form of flat plates radially extending from the outer circumference of the shaft 52, and small-radius vanes 54 continuous from the lower ends of the large-radius vanes 60 via a tapered annular member 62. In this embodiment, the large-radius vanes 60 and the small-radius vanes 54 are formed as a unitary member of a resin, and they are four flat plates, respectively, although the number may be changed appropriately. Auxiliary vanes 68 are provided in intervals of the large-radius vanes 60. The auxiliary vanes 68 serve to increase the lift of the drainage pump.

The shaft 52 has a concentric bore 53 for receiving a drive shaft 12 of the motor 10. The bevel angle of the bevelled ends of the small-radius vanes is 45 degrees, for example.

Each small-radius vane 54 has a rounded portion 57 facing to the rotating direction. The rounded portion 57 has a curvature radius approximately equal to the thickness of the small-radius vane. The rounded portions 57 reduce the noise level caused by agitation of drain water in the suction inlet 42, and drain water is smoothly pulled up into the pumping chamber 44 by rotation of the small-radius vanes 54.

Radially outer ends of the large-radius vanes 60 and the auxiliary panes 68 are connected by a cylindrical wall member 64. The height of the cylindrical wall member 64 is such that its upper limit is lower than the upper ends of the large-radius vanes 60 and the auxiliary vanes 68. In this embodiment, the upper end of the cylindrical wall member 64 has an inward rounded edge 70.

The cylindrical wall member 64 having the above configuration allows bubbles produced from the liquid around the large-radius vanes 60 to smoothly flow to the outlet 46 and alleviates impingement of the bubbles onto the lower surface 35 of the cover 32. Thus, the noise caused by bubbles decreases. In addition, although a mass of the water returns to the pumping chamber 44 in the casing from the outlet 46 and hits the cylindrical wall member 64 when the drainage pump stops, since the mass of water gradually disperses due to a buffering function of the cylindrical wall member 64, the noise caused by the returning water is also reduced. In particular, the rounded portion 70, having a curvature radius approximately equal to the thickness of the cylindrical wall member 64, for example, makes it easy that drain water oriented in radial directions by rotation of the large-radius vanes 60 and the auxiliary vanes 68 smoothly passes over the upper edge of the cylindrical wall member 64. That is, the flow of bubbles in the liquid is smoothed and Guided toward the outlet 46. Here again, the noise decreases.

The lower end of the cylindrical wall member 64 is connected to lower edges of the large-radius vanes 60 and the auxiliary vanes 68 by the annular member 62. Although the drawings depict the cylindrical wall member 64 and the annular member 62 as a unitary member, the invention also envisages making these members in separate bodies.

The annular member 62 functions to divide the liquid surface of the drain water rising from the suction inlet 42 substantially into upper and lower portions, which results in decreasing the amount of water contacting the large-radius vanes and in alleviating generation of bubbles.

An annular opening 63 is defined between the inner circumferential edge and the center of the impeller. Lower edges of the large-radius vanes 60 and auxiliary vanes 68 are slanted toward the small-radius vanes 54, and also the annular member 62 is in form of a dish in accordance with the sloped of the vanes 60 and 68.

Moreover, by making the housing 40 and the cover 32 of plastic resin of 2 to 4 mm thick, the noise level is further reduced.

As described above, the drainage pump according to the invention uses a impeller which comprises large-radius vanes, small-radius vanes, both in form of flat plates, a cylindrical wall member connecting outer circumferential edges of the large-radius vanes, and a ring portion covering outer circumferential parts of lower edges of the large-radius vanes, such that the upper ends of the cylindrical wall member is lower than the upper ends of the large-radius vanes to facilitate a smooth flow of bubbles. As a result, drain water smoothly flows toward the outlet, and the noise level is lowered.

Additionally, by rounding the upper edge of the cylindrical wall member, a low-noise air conditioner with a smooth flow of bubbles and a low noise level can be realized.

Also the lower rounded portions of the small-diameter vanes facing the suction inlet ensures a smooth contact with drain water and a reduction in noise level.

Moreover, an increased thickness of a resin constituting the pump housing and the cover also contributes to preventing leakage of noise to the exterior.

What is claimed is:

1. A drainage pump having a motor, an impeller coupled to a drive shaft of the motor, and a pump housing accommodating the impeller therein, wherein said impeller comprises:

a shaft coupled to the drive shaft of said motor;

a plurality of large-radius vanes in form of flat plates radially extending from said shaft;

small-radius vanes in form of flat plates continuous from lower ends of said large-radius vanes;

a cylindrical wall member connecting outer circumferential edges of said large-radius vanes; and an annular member extending radially inward from said cylindrical wall member along lower edges of said large-radius vanes, the height of the upper edge of said cylindrical member being lower than the height of the upper edges of said large-radius vanes.

2. The drainage pump according to claim 1, wherein said annular member defines an opening between the inner circumferential edge thereof and the center of said impeller.

3. The drainage pump according to claim 1, wherein said cylindrical wall member has a rounded portion along the inner side of the upper edge thereof.

4. The drainage pump according to claim 1, wherein each said small-radius vane has a rounded portion at one side of the lower edge thereof which faces toward the rotating direction thereof.

* * * * *